US010408566B2

(12) United States Patent
Pagac

(10) Patent No.: US 10,408,566 B2
(45) Date of Patent: Sep. 10, 2019

(54) FLEXIBLE POCKET HOLSTER

(71) Applicant: Stephen J Pagac, Tucson, AZ (US)

(72) Inventor: Stephen J Pagac, Tucson, AZ (US)

( * ) Notice: Subject to any disclaimer, the term of this patent is extended or adjusted under 35 U.S.C. 154(b) by 56 days.

(21) Appl. No.: 15/469,365

(22) Filed: Mar. 24, 2017

(65) Prior Publication Data

US 2017/0276454 A1 Sep. 28, 2017

Related U.S. Application Data

(60) Provisional application No. 62/312,580, filed on Mar. 24, 2016.

(51) Int. Cl.
*F41C 33/04* (2006.01)
*F41C 33/02* (2006.01)

(52) U.S. Cl.
CPC ..... *F41C 33/048* (2013.01); *F41C 33/0245* (2013.01)

(58) Field of Classification Search
CPC ..... F41C 33/048; F41C 33/0245
USPC ..... 224/243, 192, 193, 238
See application file for complete search history.

(56) References Cited

U.S. PATENT DOCUMENTS 694,969 A * 3/1902 Kemp ..... F41C 33/008 42/106
1,166,781 A * 1/1916 Parrish ..... A45F 5/021 224/193
2,765,107 A * 10/1956 Browning ..... F41C 33/0245 224/255
2,951,622 A * 9/1960 Heim ..... F41C 33/0209 224/192
3,315,855 A * 4/1967 Boone ..... A45F 5/02 224/255
5,012,965 A * 5/1991 Miller ..... F41C 33/0209 224/230
5,749,507 A * 5/1998 Wood ..... F41A 23/18 224/255
9,109,857 B2 * 8/2015 Kendrick ..... F41C 33/0245
9,170,064 B2 * 10/2015 Rogers ..... F41A 35/00
9,182,205 B2 * 11/2015 Sitz ..... F41A 23/18
9,261,328 B2 * 2/2016 Sitz ..... F41C 33/0245
9,574,847 B2 * 2/2017 Rossi ..... F41C 33/048
2006/0022007 A1 * 2/2006 Hughes ..... A45F 5/00 224/671
2012/0255979 A1 * 10/2012 Sitz ..... F41A 23/18 224/243

(Continued)

*Primary Examiner* — Nathan J Newhouse
*Assistant Examiner* — Lester L Vanterpool

(57) ABSTRACT

A flexible pocket holster is used to secure and conceal a firearm within a pocket pouch, or similar receptacle. The flexible pocket holster comprises a holster fin, a support base, and a barrel-supporting rod. The holster fin is a flexible panel which is used to cover the trigger of a firearm and conceal the shape of the firearm. The holster fin may be sized or shaped to accept various types of firearms. The support base is mounted onto the holster fin, adjacent to a base edge and a barrel edge of the holster fin. The barrel-supporting rod is mounted normal to the support base and opposite to the base edge. When using the flexible pocket holster, the barrel of the firearm is mounted about the barrel-supporting rod. This helps to secure the firearm and allows the firearm to be easily removed from the flexible pocket holster.

15 Claims, 8 Drawing Sheets

(56) References Cited

U.S. PATENT DOCUMENTS

| | | | | |
|---|---|---|---|---|
| 2013/0327799 | A1* | 12/2013 | Sitz | F41A 23/18<br>224/243 |
| 2014/0252053 | A1* | 9/2014 | Rogers | F41A 35/00<br>224/230 |

* cited by examiner

FLEXIBLE POCKET HOLSTER

The current application claims a priority to the U.S. Provisional Patent application Ser. No. 62/312,580 filed on Mar. 24, 2016.

FIELD OF THE INVENTION

The present invention relates generally to firearm holsters and the like. More particularly, the present invention is a flexible pocket holster which is used to securely store and conceal a firearm within a pocket, pouch, or similar receptacle.

BACKGROUND OF THE INVENTION

Holsters are commonly used to carry and conceal firearms. Though many pocket carry holsters are effective in accomplishing this task, many pocket carry holsters are designed to fit specific gun models and cannot be used with a wide range of firearms. Furthermore, most pocket holsters are bulky and can be uncomfortable to wear or carry. This bulkiness also makes it difficult for users to conceal their firearms. Many existing pocket holsters provide little flexibility and may easily be removed from a pocket when attempting to draw the firearm. When this happens, the user must then waste time removing the holster from the firearm. This added time can mean the difference between life and death when faced with a dangerous situation.

Accordingly, there is a present need for a pocket holster which is flexible, thin, and does not impede the user's ability to draw a firearm. The present invention is a flexible pocket holster which may be used to conceal and carry various models of firearms. The flexible pocket holster is designed to fit comfortably within a pocket, pouch, purse, or any similar receptacle and will maintain an upright orientation. The flexible pocket holster is also designed to not follow the firearm out of the pocket when the firearm is drawn. The flexible pocket holster may be sized to fit revolvers or semi-automatic pistols and may scaled to fit firearms of different sizes or calibers.

DETAILED DESCRIPTION OF THE INVENTION

All illustrations of the drawings are for the purpose of describing selected versions of the present invention and are not intended to limit the scope of the present invention.

Figure 1:
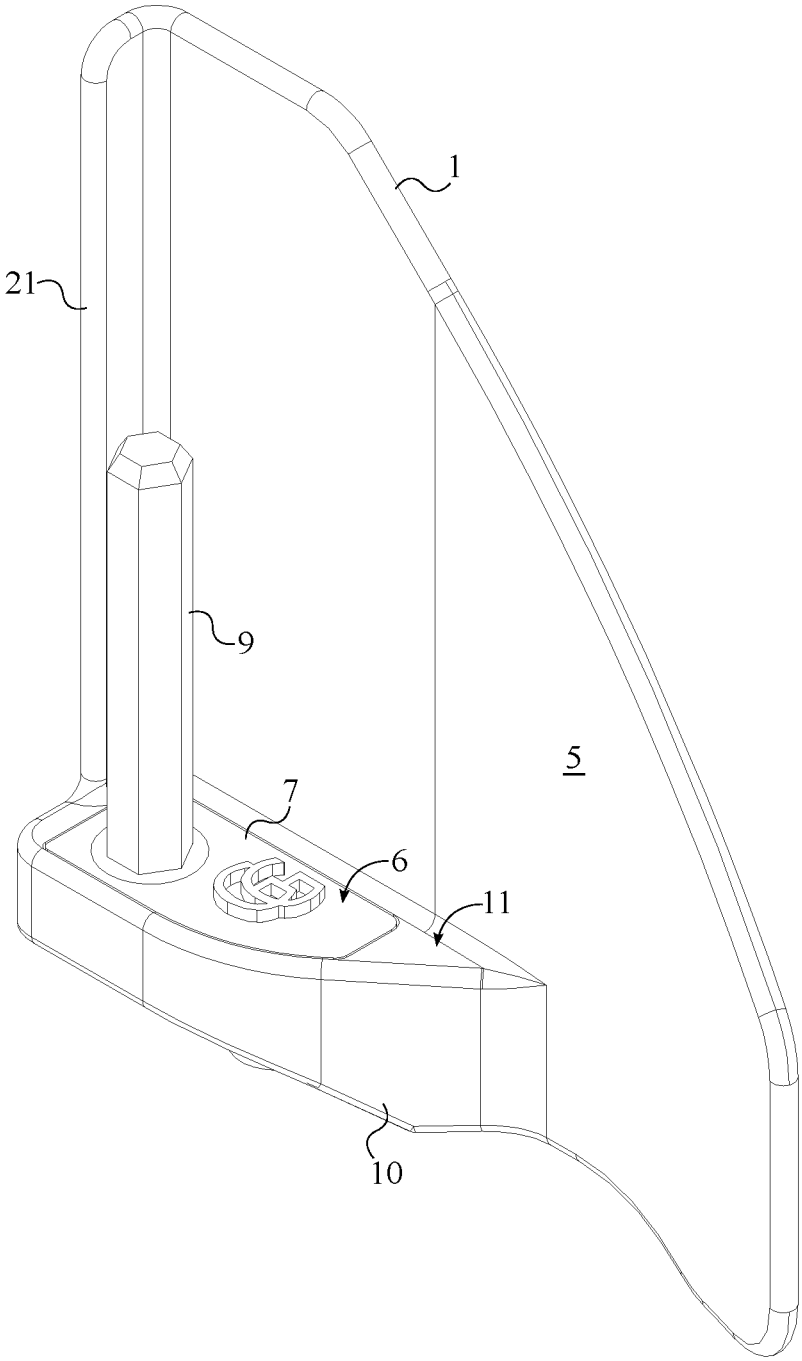
FIG. 1 is a top right perspective view of the present invention.
Figure 2:
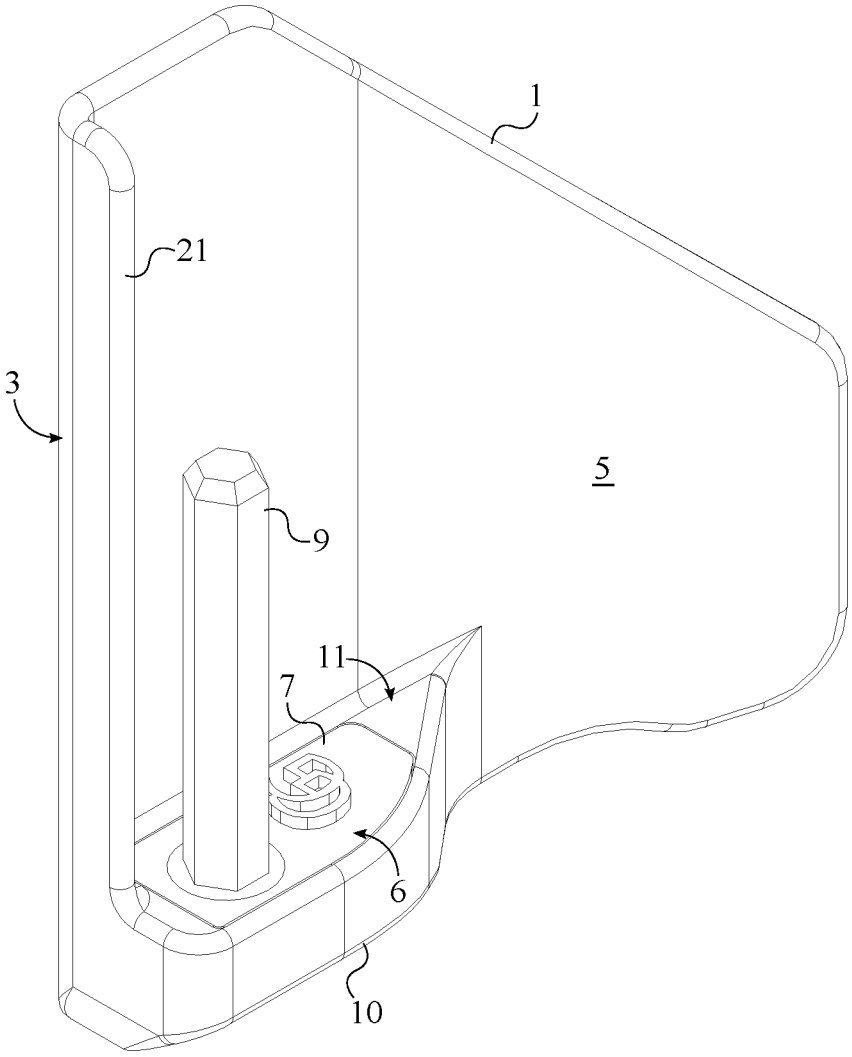
FIG. 2 is a top left perspective view of the present invention.
Figure 3:
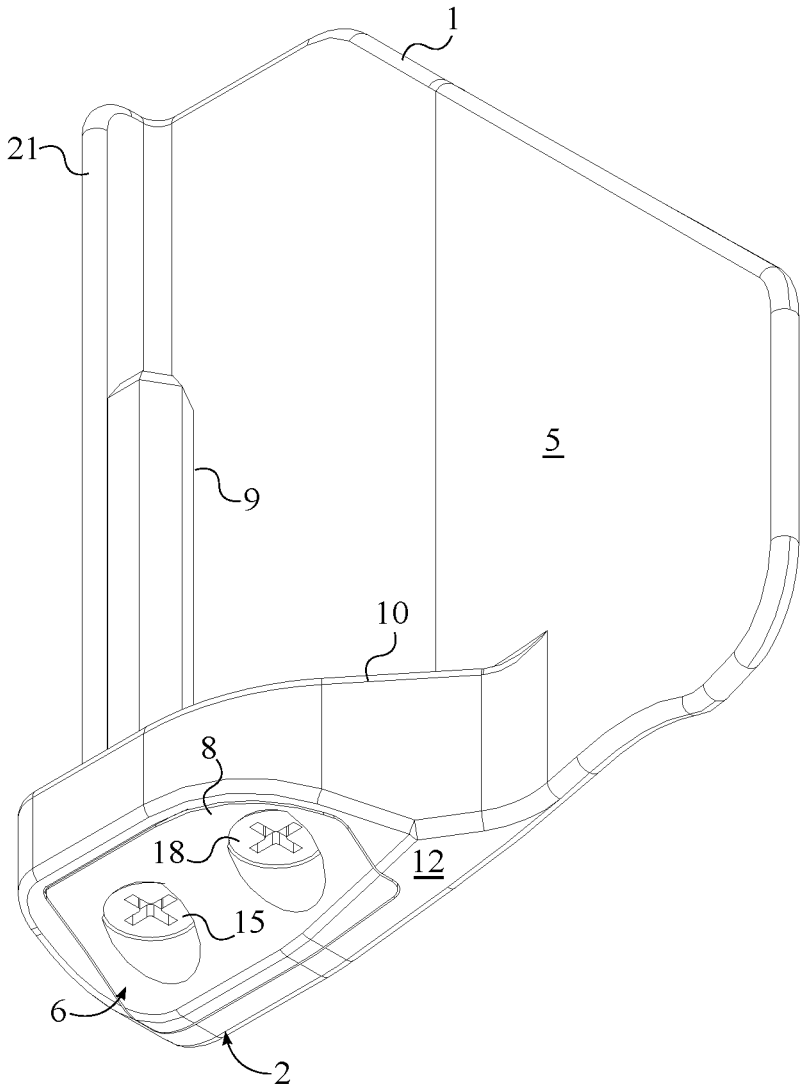
FIG. 3 is a bottom right perspective view of the present invention.

With reference to FIGS. 1-3, the present invention is a flexible pocket holster that may be used to carry and conceal a firearm within a pocket, pouch, purse, or similar receptacle. The flexible pocket holster is designed to stabilize the firearm in an upright position within the pocket and does not follow the firearm out of the pocket when drawing the firearm. The present invention comprises a holster fin 1, a support base 6, and a barrel-supporting rod 9. The holster fin 1 rests against the firearm and is used to conceal the shape of the firearm within a pocket. The holster fin 1 covers one side of the firearm, leaving the other side free. This allows firearms with attachments or accessories to be used with the flexible pocket holster. The holster fin 1 also covers the trigger area of the firearm that is exposed to the hand in the pocket. This helps prevent accidental discharge of the firearm. The holster fin 1 does not conform to the shape of the firearm like other pocket holsters do. This allows the firearm to be easily removed from the flexible pocket holster without dislodging the flexible pocket holster from the pocket. In the preferred embodiment of the present invention, the holster fin 1 is made from a flexible material which helps to improve comfort.

In reference to FIGS. 1-3, the holster fin 1 comprises a base edge 2 and a barrel edge 3. The base edge 2 is positioned adjacent and perpendicular to the barrel edge 3. When using the flexible pocket holster, the base edge 2 is designed to align with the bottom of a pocket. The barrel edge 3 aligns with the barrel or slide of a firearm in order to conceal the shape of the firearm. The support base 6 is laterally mounted to the holster fin 1, adjacent to the base edge 2. The support base 6 is positioned adjacent to the barrel edge 3 and perpendicular to the holster fin 1. The support base 6 provides a surface for the muzzle of the firearm to rest against. The barrel-supporting rod 9 is mounted normal to the support base 6 and is positioned parallel to the barrel edge 3. The barrel-supporting rod 9 is designed such that barrel of the firearm may slide over the barrel-supporting rod 9 and be secured in place. The barrel-supporting rod 9 acts as a guide for aligning and securing the firearm to the flexible pocket holster without gripping the barrel of the firearm. The barrel-supporting rod 9 is sized relative to the firearm such that the firearm may be easily removed from the barrel-supporting rod 9 and may fit firearms of varying calibers or sizes.

In reference to FIGS. 2-3, the present invention further comprises an interfacing platform 10. The interfacing platform 10 is used to mount the support base 6 to the holster fin 1. The interfacing platform 10 is laterally connected to the holster fin 1, adjacent to the base edge 2. Further, the interfacing platform 10 is positioned adjacent to the barrel edge 3. The support base 6 comprises a first interlocking portion 7 and a second interlocking portion 8 which clamp onto the interfacing platform 10. To do so, the first interlocking portion 7 and the second interlocking portion 8 are connected adjacent to each other through the interfacing platform 10. The second interlocking portion 8 is positioned adjacent to the base edge 2. In the preferred embodiment of the present invention, the second interlocking portion 8 comprises an angled surface which is positioned opposite to the first interlocking portion 7. The angled surface helps to slim the profile of the flexible pocket holster in order to limit bulk and improve comfort. The barrel-supporting rod 9 is connected normal to the first interlocking portion 7, opposite to the second interlocking portion 8. In this arrangement, the barrel-supporting rod 9 is used to orient and secure the firearm such that the trigger of the firearm is covered by the holster fin 1.

Figure 4:
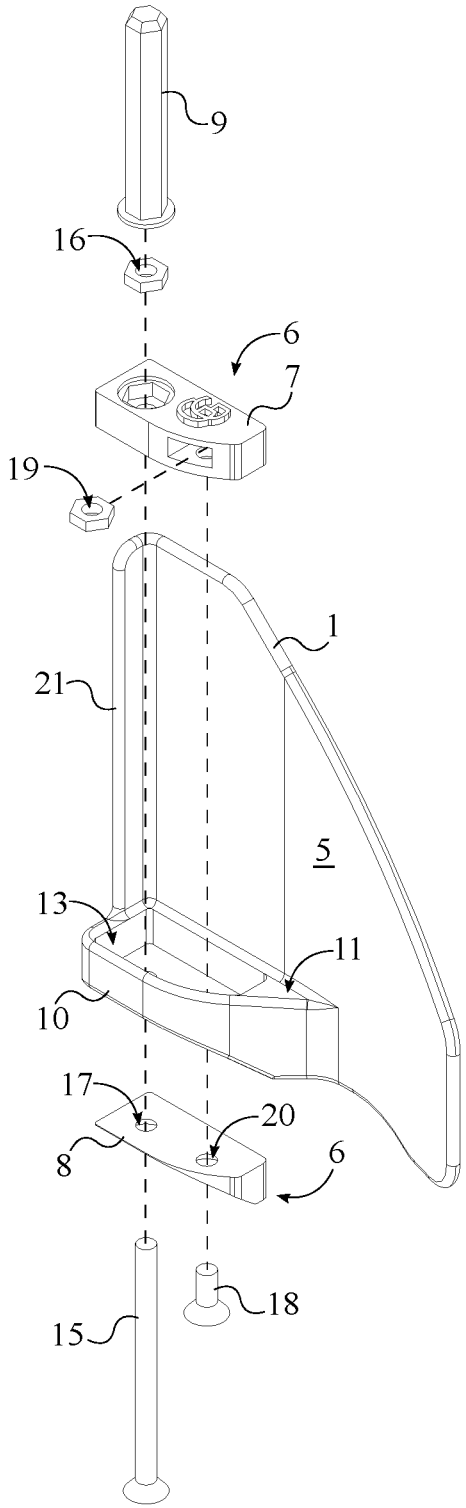
FIG. 4 is an exploded top perspective view of the present invention.
Figure 5:
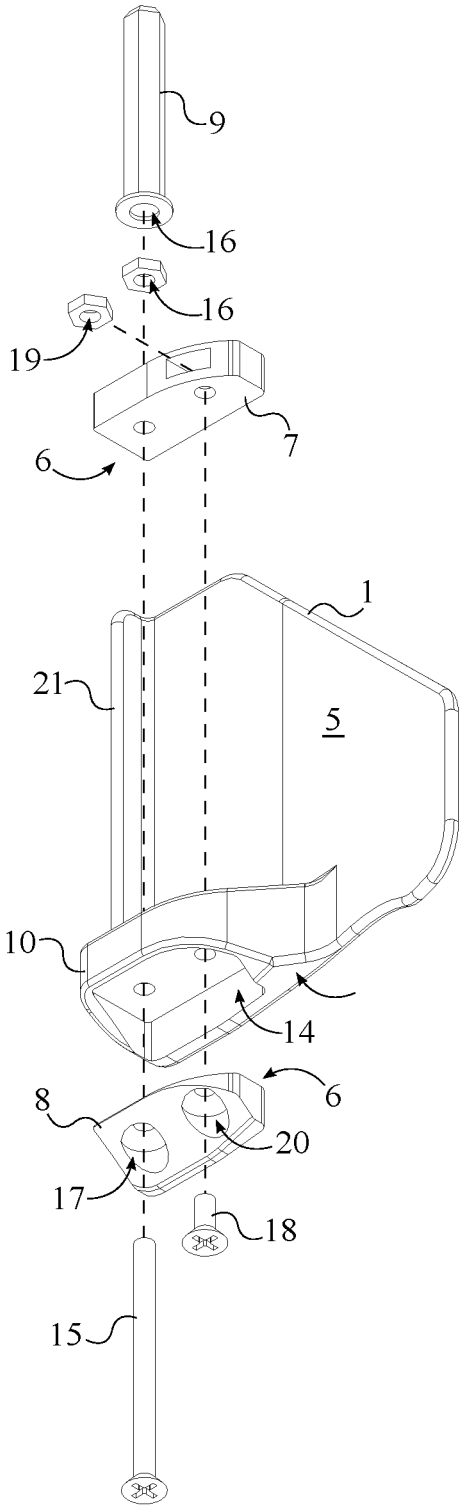
FIG. 5 is an exploded bottom perspective view of the present invention.

In reference to FIGS. 4-5, the present invention further comprises a first base channel 13 and a second base channel 14. The first base channel 13 traverses into a first surface 11 of the interfacing platform 10 and is used to mount the first interlocking portion 7 to the interfacing platform 10. The second base channel 14 traverses into a second surface 12 of the interfacing platform 10, opposite to the first surface 11. Similar to the first base channel 13, the second base channel 14 is used to mount the second interlocking portion 8 to the interfacing platform 10. The first interlocking portion 7 is positioned into the first base channel 13 and the second interlocking portion 8 is positioned into the second base channel 14. In the preferred embodiment of the present invention, the first base channel 13 and the second base channel 14 are sized such that the first interlocking portion 7 is aligned flush to the first base surface and the second interlocking portion 8 is aligned flush to the second base surface. This arrangement provides a smooth appearance and makes the flexible pocket holster more comfortable to carry within a pocket.

In reference to FIGS. 4-5, the present invention further comprises a first male-threaded fastener 15, a first female-threaded hole 16, and a first unthreaded hole 17. The first female-threaded hole 16 traverses through the first interlocking portion 7 and into the barrel-supporting rod 9. This arrangement allows the barrel-supporting rod 9 to be secured to the first interlocking portion 7 using only the first male-threaded fastener 15. The first unthreaded hole 17 traverses through the second interlocking portion 8. The first female-threaded hole 16 and the first unthreaded hole 17 are concentrically aligned such that the first male-threaded fastener 15 may be aligned with both the first female-threaded hole 16 and the first unthreaded hole 17. The first male-threaded fastener 15 is engaged into the first female-threaded hole 16, through the first unthreaded hole 17. This arrangement allows the first interlocking portion 7 and the second interlocking portion 8 to be secured to each other through the interfacing platform 10. In the preferred embodiment of the present invention, the first female-threaded hole 16 is embodied as a nut which is mounted into the first interlocking portion 7.

In reference to FIGS. 4-5, the present invention further comprises a second male-threaded fastener 18, a second female-threaded hole 19, and a second unthreaded hole 20. The second female-threaded hole 19 traverses into the first interlocking portion 7. The second unthreaded hole 20 traverses through the second interlocking portion 8. The second female-threaded hole 19 and the second unthreaded hole 20 are concentrically aligned such that the second male-threaded fastener 18 may be aligned with both the second female-threaded hole 19 and the second unthreaded hole 20. The second male-threaded fastener 18 is engaged into the second female-threaded hole 19, through the second unthreaded hole 20. This arrangement allows the first interlocking portion 7 and the second interlocking portion 8 to be secured to each other through the interfacing platform 10. In the preferred embodiment of the present invention, the second female-threaded hole 19 is embodied as a nut which is laterally mounted into the first interlocking portion 7.

In reference to FIGS. 1-2, the present invention further comprises a reinforcing lip 21. The reinforcing lip 21 is used to structurally reinforce the holster fin 1 and to provide a surface for the barrel or slide of the firearm to rest against. The reinforcing lip 21 is connected normal to the holster fin 1 and traverses along the barrel edge 3. The reinforcing lip 21 is oriented towards the support base 6 but does not protrude from the holster fin 1 as far as the support base 6. This is done to slim the shape of the flexible pocket holster.

Figure 6:
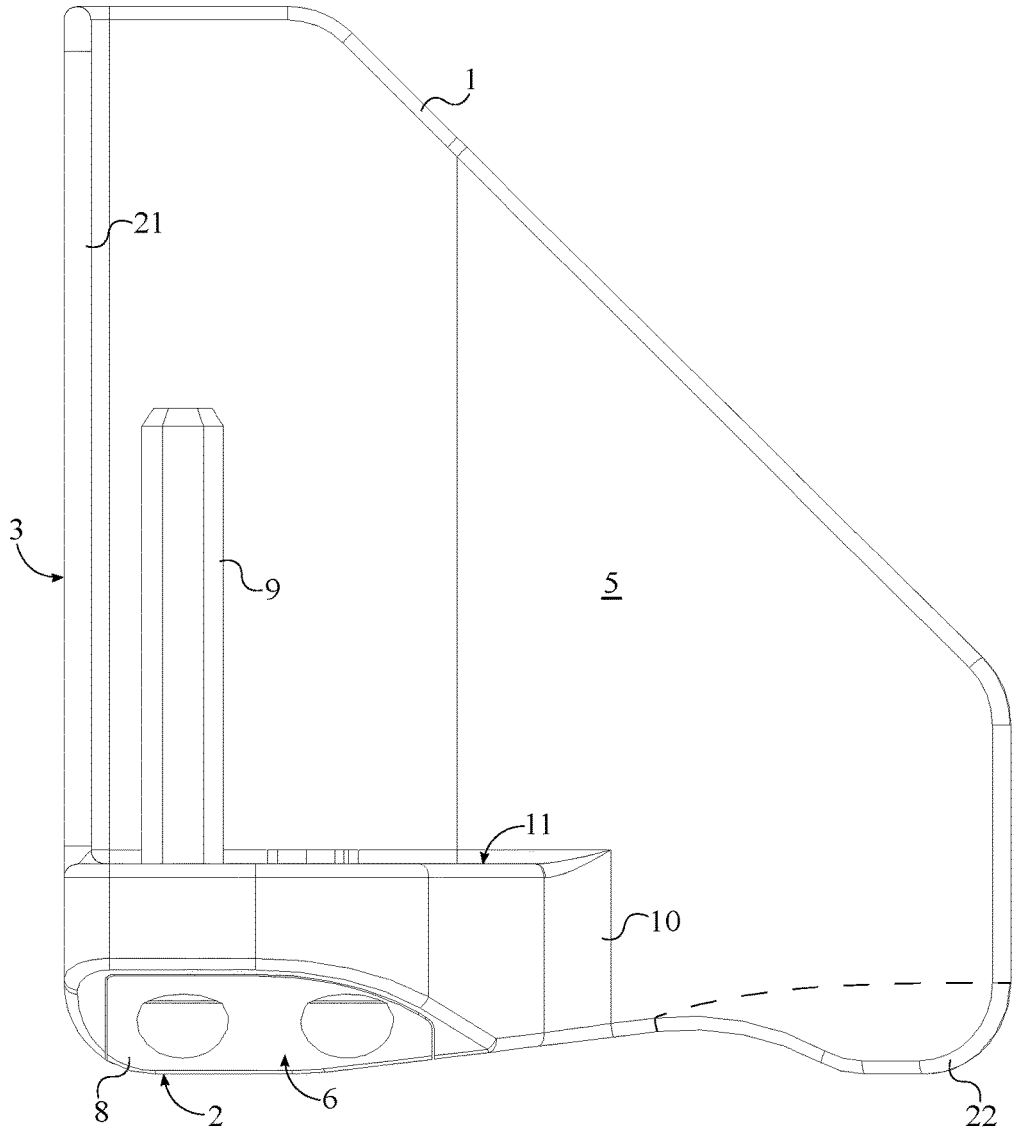
FIG. 6 is a front view of the present invention showing the anchoring protrusion with a dashed line.

In reference to FIG. 6, the present invention further comprises an anchoring protrusion 22. The anchoring protrusion 22 is connected adjacent to the base edge 2 and is positioned opposite to the barrel edge 3. The anchoring protrusion 22 is used to secure the flexible pocket holster within a pocket or a pouch and to ensure that the flexible pocket holster is oriented in an upright position.

Figure 8:
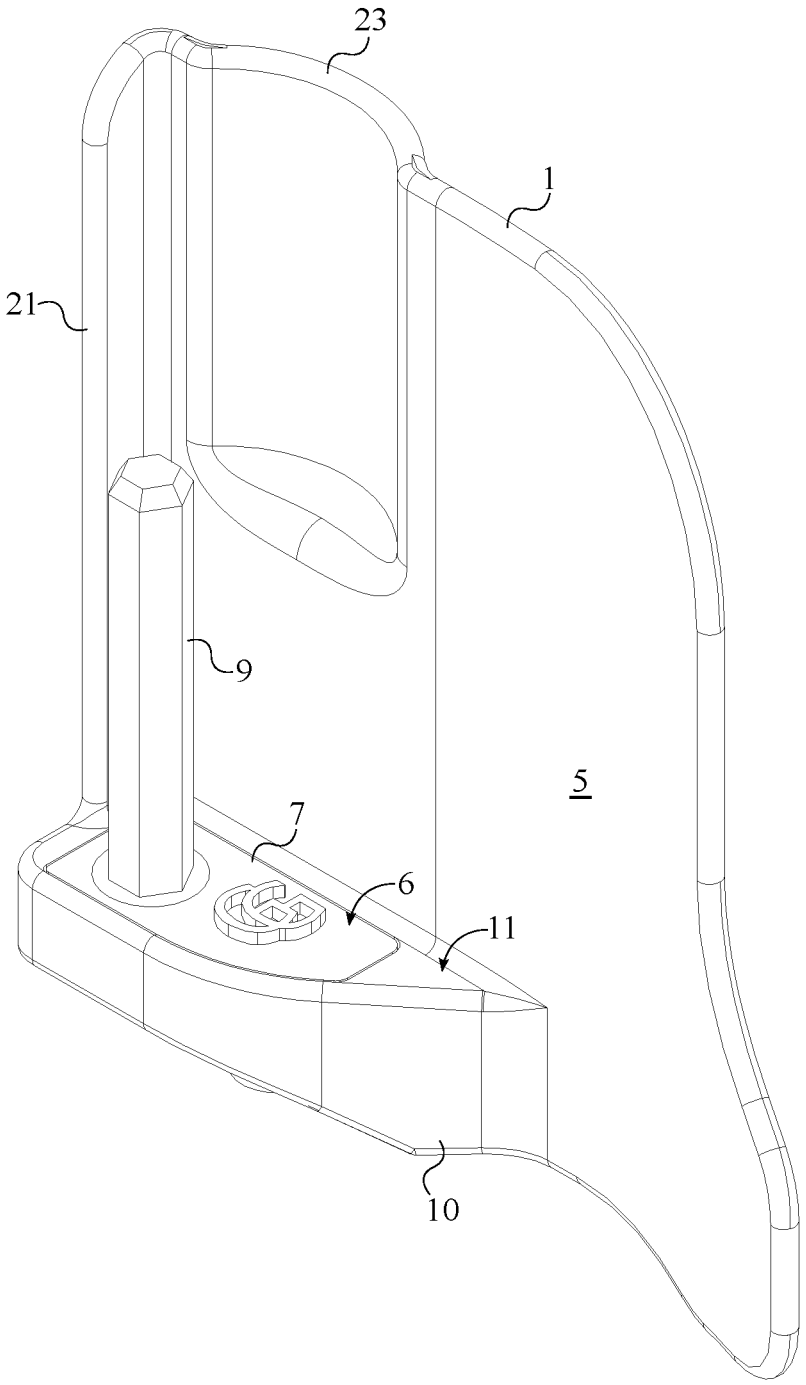
FIG. 8 is a top right perspective view of the present invention with the cylinder shell.

Because revolvers and semi-automatic pistols have differing shapes, the present invention may be made in different shapes or styles to accommodate different firearms. In reference to FIG. 8, in order to accommodate for revolvers, the present invention further comprises a cylinder shell 23. The cylinder shell 23 is integrated into the holster fin 1. The cylinder shell 23 creates a recessed area which provides clearance for the cylinder of a revolver to fit into. The cylinder shell 23 is offset from the support base 6 and is positioned adjacent to the barrel edge 3 so as to align with the shape of the revolver. The cylinder shell 23 extends to a free edge of the holster fin 1, opposite to the base edge 2, allowing the cylinder to clear the cylinder shell 23 when removing the revolver from the flexible pocket holster and the pocket.

Figure 7:
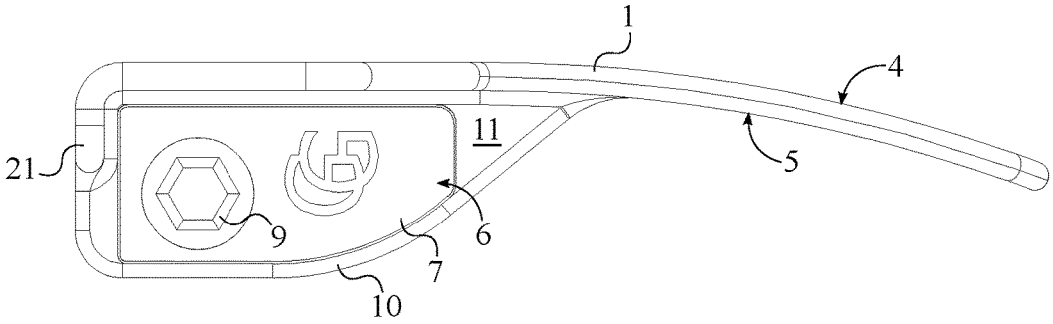
FIG. 7 is a top view of the present invention.

In reference to FIG. 1 and FIG. 7, the holster fin 1 comprises a pocket-facing surface 4 and a gun-facing surface 5. The pocket-facing surface 4 and the gun-facing surface 5 are positioned opposite to each other about the holster fin 1. In the preferred embodiment of the present invention, the pocket-facing surface 4 is convex and the gun-facing surface 5 is concave. This arrangement creates a curvature to the holster fin 1 which naturally conforms to the shape of a human leg and fits comfortably within a pocket.

Although the invention has been explained in relation to its preferred embodiment, it is to be understood that many other possible modifications and variations can be made without departing from the spirit and scope of the invention as hereinafter claimed.

What is claimed is:

1. A flexible pocket holster comprises:

a holster fin;

a support base;

a barrel-supporting rod;

the holster fin comprises a base edge and a barrel edge;

the base edge being positioned adjacent and perpendicular to the barrel edge;

the support base being laterally mounted to the holster fin, adjacent to the base edge;

the support base being positioned adjacent to the barrel edge;

the support base being positioned perpendicular to the holster fin;

the barrel-supporting rod being mounted normal to the support base;

the barrel-supporting rod being positioned parallel to the barrel edge;

an interfacing platform;

the support base comprises a first interlocking portion and a second interlocking portion;

the interfacing platform being laterally connected to the holster fin, adjacent to the base edge;

the interfacing platform being positioned adjacent to the barrel edge;

the first interlocking portion and the second interlocking portion being connected adjacent to each other through the interfacing platform;

the second interlocking portion being positioned adjacent to the base edge; and the barrel-supporting rod being connected normal to the first interlocking portion, opposite to the second interlocking portion.

2. The flexible pocket holster as claimed in claim 1 comprises:

a first base channel;

a second base channel;

the first base channel traversing into a first surface of the interfacing platform;

the second base channel traversing into a second surface of the interfacing platform, opposite to the first surface;

the first interlocking portion being positioned into the first base channel; and the second interlocking portion being positioned into the second base channel.

3. The flexible pocket holster as claimed in claim 2 comprises:

a first male-threaded fastener;

a first female-threaded hole;

a first unthreaded hole;

the first female-threaded hole traversing through the first interlocking portion, and into the barrel-supporting rod;

the first unthreaded hole traversing through the second interlocking portion; and the first male-threaded fastener being engaged into the first female-threaded hole, through the first unthreaded hole.

4. The flexible pocket holster as claimed in claim 2 comprises:

a second male threaded fastener;

a second female-threaded hole;

a second unthreaded hole;

the second female-threaded hole traversing into the first interlocking portion, the second unthreaded hole traversing through the second interlocking portion; and the second male-threaded fastener being engaged into the second female-threaded hole, through the second unthreaded hole.

5. The flexible pocket holster as claimed in claim 1 comprises:

a reinforcing lip;

the reinforcing lip being connected normal to the holster fin;

the reinforcing lip traversing along the barrel edge; and the reinforcing lip being oriented towards the support base.

6. The flexible pocket holster as claimed in claim 1 comprises:

an anchoring protrusion;

the anchoring protrusion being connected adjacent to the base edge; and the anchoring protrusion being positioned opposite to the barrel edge.

7. The flexible pocket holster as claimed in claim 1 comprises:

a cylinder shell;

the cylinder shell being integrated into the holster fin;

the cylinder shell being offset from the support base; and the cylinder shell being positioned adjacent to the barrel edge.

8. The flexible pocket holster as claimed in claim 1 comprises:

the holster fin comprises a pocket-facing surface and a gun-facing surface;

the pocket-facing surface and the gun-facing surface being positioned opposite to each other about the holster fin;

the pocket-facing surface being convex; and the gun-facing surface being concave.

9. A flexible pocket holster comprises:

a holster fin;

a support base;

a barrel-supporting rod;

an anchoring protrusion;

the holster fin comprises a base edge and a barrel edge;

the base edge being positioned adjacent and perpendicular to the barrel edge;

the support base being laterally mounted to the holster fin, adjacent to the base edge;

the support base being positioned adjacent to the barrel edge;

the support base being positioned perpendicular to the holster fin;

the barrel-supporting rod being mounted normal to the support base;

the barrel-supporting rod being positioned parallel to the barrel edge;

the anchoring protrusion being connected adjacent to the base edge;

the anchoring protrusion being positioned opposite to the barrel edge;

an interfacing platform;

the support base comprises a first interlocking portion and a second interlocking portion;

the interfacing platform being laterally connected to the holster fin, adjacent to the base edge;

the interfacing platform being positioned adjacent to the barrel edge;

the first interlocking portion and the second interlocking portion being connected adjacent to each other through the interfacing platform;

the second interlocking portion being positioned adjacent to the base edge; and the barrel-supporting rod being connected normal to the first interlocking portion, opposite to the second interlocking portion.

10. The flexible pocket holster as claimed in claim 9 comprises:

a first base channel;

a second base channel;

the first base channel traversing into a first surface of the interfacing platform;

the second base channel traversing into a second surface of the interfacing platform, opposite to the first surface;

the first interlocking portion being positioned into the first base channel; and the second interlocking portion being positioned into the second base channel.

11. The flexible pocket holster as claimed in claim 10 comprises:

a first male-threaded fastener;

a first female-threaded hole;

a first unthreaded hole;

the first female-threaded hole traversing through the first interlocking portion, and into the barrel-supporting rod;

the first unthreaded hole traversing through the second interlocking portion; and the first male-threaded fastener being engaged into the first female-threaded hole, through the first unthreaded hole.

12. The flexible pocket holster as claimed in claim 10 comprises:

a second male threaded fastener;

a second female-threaded hole;

a second unthreaded hole;

the second female-threaded hole traversing into the first interlocking portion;

the second unthreaded hole traversing through the second interlocking portion; and the second male-threaded fastener being engaged into the second female-threaded hole, through the second unthreaded hole.

13. The flexible pocket holster as claimed in claim 9 comprises:

a reinforcing lip;

the reinforcing lip being connected normal to the holster fin;

the reinforcing lip traversing along the barrel edge; and the reinforcing lip being oriented towards the support base.

14. The flexible pocket holster as claimed in claim 9 comprises:

a cylinder shell;

the cylinder shell being integrated into the holster fin;

the cylinder shell being offset from the support base; and the cylinder shell being positioned adjacent to the barrel edge.

15. The flexible pocket holster as claimed in claim 9 comprises:

the holster fin comprises a pocket-facing surface and a gun-facing surface;

the pocket-facing surface and the gun-facing surface being positioned opposite to each other about the holster fin;

the pocket-facing surface being convex; and the gun-facing surface being concave.

* * * * *